US009581375B2

(12) United States Patent
Perez López

(10) Patent No.: US 9,581,375 B2
(45) **Date of Patent: *Feb. 28, 2017**

(54) COOLING APPARATUS FOR COOLING A LIQUID IN A CONTAINER

(71) Applicant: ICEJET, S.L., Gava Barcelona (ES)

(72) Inventor: Gustavo Perez López, Barcelona (ES)

(73) Assignee: ICEJET, S.L., Barcelona (ES)

( * ) Notice: Subject to any disclaimer, the term of this patent is extended or adjusted under 35 U.S.C. 154(b) by 18 days.

This patent is subject to a terminal disclaimer.

(21) Appl. No.: 14/816,460

(22) Filed: Aug. 3, 2015

(65) Prior Publication Data

US 2015/0338152 A1 Nov. 26, 2015

Related U.S. Application Data

(63) Continuation of application No. 13/817,143, filed as application No. PCT/ES2011/070262 on Apr. 15, 2011, now Pat. No. 9,097,453.

(30) Foreign Application Priority Data

Apr. 16, 2010 (ES) ..... 201030556
Dec. 10, 2010 (ES) ..... 201031820

(51) Int. Cl.
*F25D 3/10* (2006.01)
*F28D 1/02* (2006.01)
(Continued)

(52) U.S. Cl.
CPC ..... *F25D 3/107* (2013.01); *F28D 1/0213* (2013.01); *F25D 31/002* (2013.01); *F28D 7/02* (2013.01); *F28F 1/14* (2013.01); *F28F 1/24* (2013.01)

(58) Field of Classification Search
CPC ..... F25D 3/107; F25D 31/002; F28D 1/0213; F28D 7/02; F28F 1/14; F28F 1/24
(Continued)

(56) References Cited

U.S. PATENT DOCUMENTS 2,805,554 A 9/1957 Schachtsiek
3,269,141 A 8/1966 Weiss
(Continued)

FOREIGN PATENT DOCUMENTS

CN 1183084 5/1998
CN 1183084 A 5/1998
(Continued)

OTHER PUBLICATIONS

Extended European Search Report (EESR) for European Application No. 15157861.4, issued by the European Patent Office on Jul. 30, 2015, 7 pages, Munich Germany.
(Continued)

*Primary Examiner* — Mohammad M Ali
(74) *Attorney, Agent, or Firm* — Edell, Shapiro & Finnan, LLC

(57) ABSTRACT

A liquid container designed to include an autonomous selective cooling device and cooling device applicable to the liquid container. The cooling device includes a heat exchanger comprising a first body with a cavity, a second body inside the cavity, a fluid passage formed between an outer surface of the second body and the surface of the cavity, and some means for causing a cooling fluid to flow while expanding along fluid passage up to an exhaust duct of the second body. A container comprises a cavity for a liquid, a first filling opening provided with a first closing element and a second opening with a first coupling element where a second coupling element is coupled to the second coupling element being formed at an extension of a second
(Continued)

closure cap and connected to the heat exchanger, in such a way that the closure cap closes the second opening of the container and the heat exchanger is housed in the cavity of the container and in contact with the liquid contained in it.

20 Claims, 7 Drawing Sheets

(51) Int. Cl.
*F25D 31/00* (2006.01)
*F28D 7/02* (2006.01)
*F28F 1/14* (2006.01)
*F28F 1/24* (2006.01)

(58) Field of Classification Search
USPC ..... 62/457.9
See application file for complete search history.

(56) References Cited

U.S. PATENT DOCUMENTS 3,564,866 A * 2/1971 Fraze ..... F25D 3/107 417/405
4,118,946 A * 10/1978 Tubin ..... A41D 13/0053 126/204
4,204,613 A * 5/1980 Terzian ..... B67D 3/0009 165/163
4,341,263 A 7/1982 Morteza
4,498,524 A * 2/1985 Jacobsen ..... F28D 7/02 165/103
5,331,817 A 7/1994 Anthony
5,555,741 A * 9/1996 Oakley ..... F25D 3/107 222/5
5,571,233 A * 11/1996 Rolland ..... F16L 55/103 137/825
6,103,280 A * 8/2000 Molzahn ..... A23G 9/00 426/109
6,125,649 A 10/2000 Sillince
6,128,906 A 10/2000 Sillince
6,167,718 B1 * 1/2001 Halimi ..... F25D 3/107 126/263.04
6,443,334 B1 9/2002 John
6,804,965 B2 * 10/2004 Abras ..... F25B 21/02 165/156
6,830,661 B1 12/2004 Land
6,854,280 B2 2/2005 Jeuch
7,028,505 B2 4/2006 Cardinale
7,217,343 B2 5/2007 Land
2002/0178743 A1 12/2002 Halimi
2003/0159448 A1 * 8/2003 Lee ..... F25D 3/107 62/60
2005/0142269 A1 6/2005 Scullion
2005/0235657 A1 10/2005 Boukas
2006/0011262 A1 * 1/2006 Stienen ..... A61L 2/208 141/147
2007/0044488 A1 3/2007 Habatjou
2007/0101734 A1 5/2007 Lucas
2008/0053117 A1 * 3/2008 Anthony ..... F25D 3/107 62/125
2008/0073358 A1 3/2008 Jeuch et al.
2008/0268107 A1 * 10/2008 Chen ..... F25D 29/001 426/109

FOREIGN PATENT DOCUMENTS

FR 1517060 A 3/1968
FR 2810015 A1 12/2001
WO WO9637742 A1 11/1996
WO WO2011128486 10/2011

OTHER PUBLICATIONS

English Translation of the International Search Report (ISR) and Written Opinion (ISA), International Application No. PCT/ES2011/070262 International Filing Date Apr. 15, 2011 Date of Mailing Aug. 10, 2011, 6 pages, Spanish Office of Patents and Trademarks, Madrid Spain.
Spanish Translation of the International Search Report (ISR) and Written Opinion (ISA), International Application No. PCT/ES2011/070262 International Filing Date Apr. 15, 2011 Date of Mailing Aug. 10, 2011, 6 pages, Spanish Office of Patents and Trademarks, Madrid Spain.

* cited by examiner

COOLING APPARATUS FOR COOLING A LIQUID IN A CONTAINER

This application is a continuation of U.S. application Ser. No. 13/817,143, filed Feb. 15, 2013, which is a 371 National stage entry of International Application Serial No. PCT/ES2011/070262, filed on Apr. 15, 2011, which claims priority to Spanish Patent Application No. P201030556, filed Apr. 16, 2010 and Spanish Patent Application No. P201031820, filed Dec. 10, 2010, the entireties of all of which are incorporated herein by this reference thereto as if fully set forth herein.

TECHNICAL FIELD

The present invention relates in a first aspect to a container being specially designed to incorporate an autonomous selective cooling device, said container preferably but not exclusively being a portable beverage container, such as for example a beverage can, a container or canteen for hiking or a bike bottle.

In a second aspect this invention relates to a selective cooling device being applicable to said liquid container.

BACKGROUND OF THE INVENTION

Document U.S. Pat. No. 6,125,649 discloses a heat exchanging unit that can be used in a packaging to cool down a food or beverage being contained in it. The heat exchanging unit includes an external container and an internal container. The internal container has a plurality of thermally conductive discs in contact with an internal surface of it. An adsorbing material is arranged between the adjacent discs and is compacted between them in order to thus provide the maximum adsorbing material per unit of volume. The external surface of the internal container defines a plurality of grooves and is in contact with the internal surface of the external container. The grooves provide flow paths for a gas, such as carbon dioxide, which is fixed by adsorption on the adsorbing material in a first stage of filling of the internal container, to latter on flow and exit the heat exchanging unit to the outside when the user acts on a valve, the gas when expanding when thus exiting or escaping then withdrawing the heat being contained in the food or beverage being arranged in the container, and thus reducing its temperature.

A drawback of the heat exchanging unit of said document U.S. Pat. No. 6,125,649 is that the internal container, with the plurality of discs and the adsorbing material between them, is of complex and cost-intensive construction imposing a substantial bulk or size, the carbon dioxide having to be filled at a filling station. Besides, once used, it is not refillable and must be discarded together with the packaging. Another drawback is that the grooves that provide the above-mentioned flow path for the gas are rectilinear and parallel to the central axis of the internal and external containers, the flow path hence being the possibly shortest one. Although in the specification reference is made to the fact that the grooves can adopt a helical development, or another path there is no explanation whatsoever as to how to carry out said alternative form.

Document US 2005/0235657 describes an apparatus for cooling down a liquid in a portable container. The apparatus comprises a housing having an upper end and a lower end, this latter being possibly adapted to be fixed to the portable container. A pressurised gas reservoir or cartridge placed inside the housing has a supply valve to expel the pressurised gas. Heat exchanging fins are arranged around an outer surface of the gas reservoir or cartridge. When the gas is expelled, the reservoir or cartridge is cooled and the heat exchanging fins absorb heat from a liquid contained in the housing or passing through it.

Nevertheless, in this apparatus being described in the aforesaid document US 2005/0235657 the gas is directly expelled from the reservoir or cartridge to the atmosphere through a supply valve without following any path whatsoever in the inside of a heat exchanging unit, the cooling hence being not very efficient.

Therefore It is already known in the prior art quoted that the gas cartridge can be coupled to the inlet duct from the outside, or be placed in the inner side of the heat exchanger

DISCLOSURE OF THE INVENTION

According to a first aspect, the present invention provides a liquid container including a selective cooling device as per the first aspect of the present invention. This container comprises a cavity for housing a liquid, at least a first opening being provided with a closing element for filling and emptying the cavity and for eventually drinking the liquid, and a second opening having a first coupling element where a second coupling element is coupled which is formed at an extension of a closure cap connected to the heat exchanger of the cooling device. In this way the closure cap of the cooling device closes said second opening of the container and the heat exchanger is thus housed in the cavity of the container and in contact with the liquid contained in it.

The container of the present invention can optionally include an alternative simple cap being provided with a coupling shape in order to be coupled to the first coupling element thus closing the second opening of the container. This alternative cap is provided to be used instead of the closure cap associated to the cooling device and thus allows the container to be used as a conventional, transportable liquid container when the liquids do no need to be cooled.

According to a second aspect, the present invention provides a selective cooling device being applicable to a liquid container. The device comprises a heat exchanger being provided with an external body and an internal body. The external body has an outer surface and a cavity with an inner surface and the internal body is housed inside said cavity of the external body. The internal and external bodies are shaped in such a way that, when they are mutually coupled to each other, a shape of said outer surface of the internal body cooperates with a shape of said inner surface of the cavity of the external body so as to thus form between them both a labyrinthine fluid passage (with diverse courses and longitudinal developments) which is in communication with an inlet duct and an exhaust duct.

According to a preferred embodiment of the invention said fluid passage is at least in part delimited by an elastically deformable surface being defined on a wall of one of said first or second bodies and subjected to compression in the interspace between both the external and the internal bodies.

The device has a connection for connecting a cooling fluid source such as for example a gas reservoir or cartridge to said inlet duct in order to cause a cooling fluid to flow at a user's will while expanding along said fluid passage of the heat exchanger from the inlet duct up to said exhaust duct, wherefrom the cooling fluid is discharged to the atmosphere. Said cooling fluid is an environmentally friendly one, such as a liquefied petroleum gas, for example.

The heat exchanger is shaped in such a way as to be at least partly housed in a container, with the outer surface of the external body in contact with a liquid contained in said container. When the cooling fluid exiting the gas reservoir or cartridge is expanded along the fluid passage of the heat exchanger and expelled to the atmosphere, the external body of the heat exchanger is cooled and absorbs heat from the liquid being in contact with it, thus lowering its temperature.

The gas reservoir or cartridge can be of a discardable, commercially available type being obtainable at a relatively low cost, or it can also be refillable, whereas the heat exchanger is preferably made of lasting materials and can be reused as many times as desired, the used up gas reservoirs or cartridges being replaced by full ones, without dismissing for the exchanger the possibility of its also being of a one-use type. For example the external body can be made of a material with a high heat-transfer coefficient, such as a metallic material, preferably a light metal alloy, being compatible with foodstuffs, in particular drinkable liquids, and the internal body can be made of a material with a low heat-transfer coefficient, such as a plastics material, this allowing to obtain a cost reduction (easy forming) and a sensible weight reduction.

BRIEF DESCRIPTION OF THE DRAWINGS

The above and other features and advantages will be more fully understood in the light of the following detailed description of some exemplary embodiments with reference to the annexed drawings, wherein.

DETAILED DESCRIPTION OF SOME EXEMPLARY EMBODIMENTS

Figure 1:
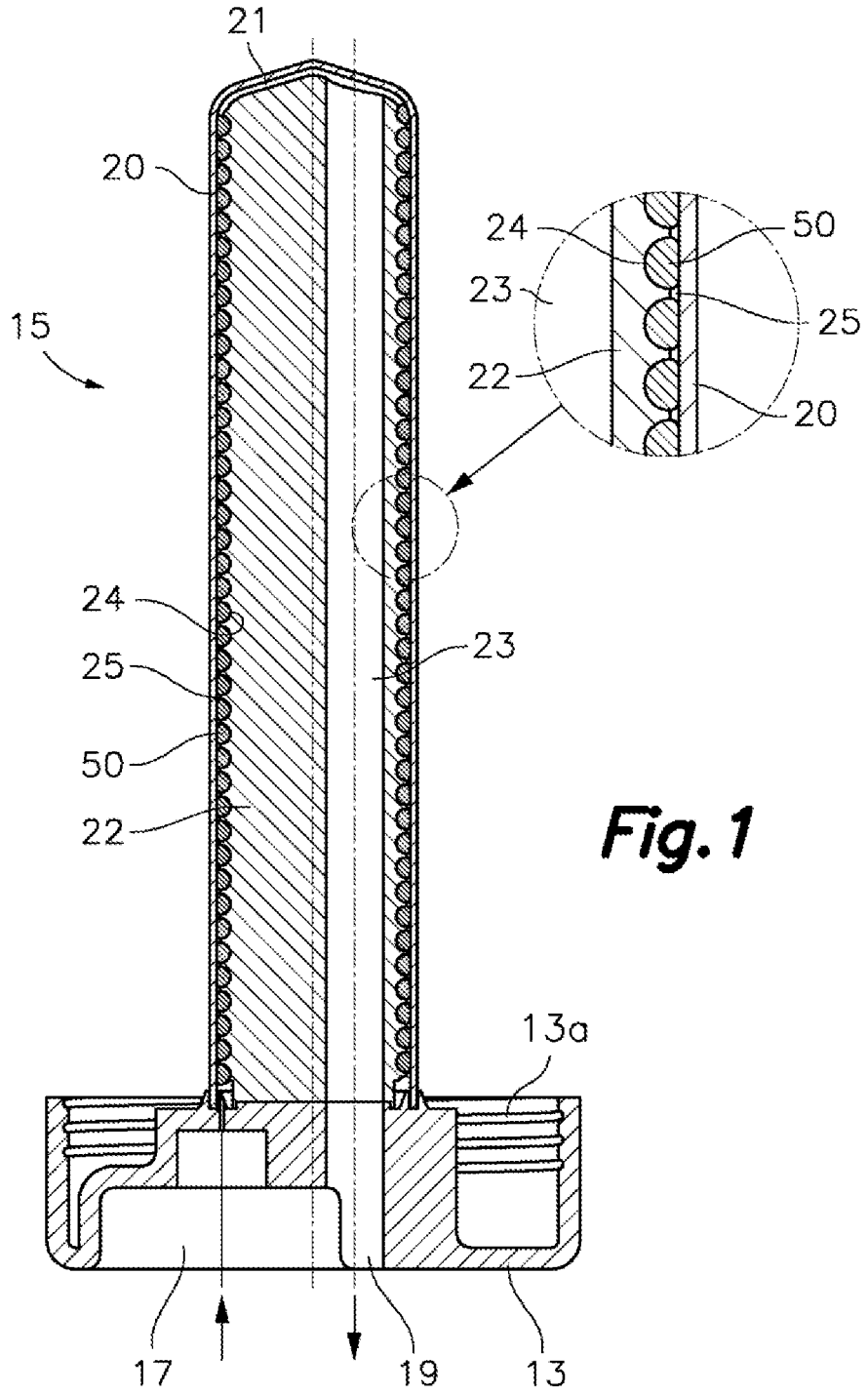
FIG. 1 is a side elevational, partially sectional view of a cooling device according to an embodiment of the second aspect of the present invention.

Firstly referring to FIG. 1, this latter shows a selective cooling device being made as per an embodiment of the first aspect of the present invention and comprising a heat exchanger 15 being provided with an external body 20 with a high heat-transfer coefficient and an internal body 22. The aforementioned external body 20 has a generally cylindrical shape and defines with respect to the internal body when this latter has been inserted into it an annular cavity 21.

Heat exchanger 15 is shaped in such a way as to be at least in part housed in the inside of a container 10, 40 with the outer surface of the first body 20 in contact with a liquid contained in said container.

The operation of the cooling device is based on the provision of a fluid passage 25 between an outer surface of the second body 22 and a surface of said cavity 21 and some means for causing a cooling to fluid to flow at a user's will while expanding along said fluid passage 25 up to an exhaust duct 19 of the internal body 22.

According to the present invention it has been provided that said fluid passage 25 is at least in part delimited by an elastically deformable surface defined on a wall of one of said first and second bodies 20, 22 and subjected to compression in the interspace between the two bodies 20, 22.

Figure 2:
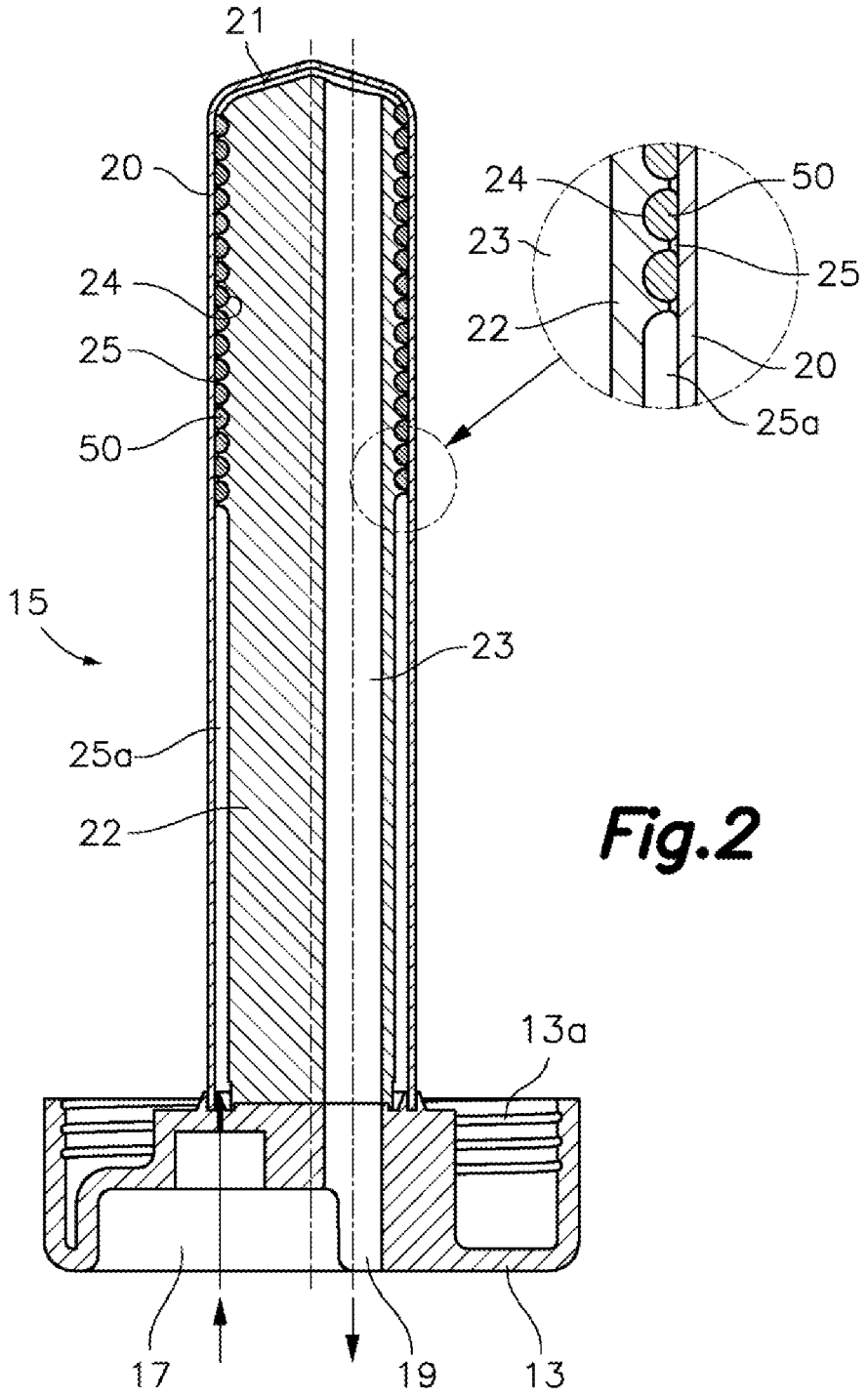
FIG. 2 is a view being equivalent to the previous one, with the difference that a helical passage for the fluid discharge is of a shorter length and only affects a portion of the interspace between the two bodies forming the exchanger.

In an exemplary embodiment of the proposal of this invention it has been provided that the aforecited fluid passage 25 is a helical passage or a passage following another labyrinthine course and spanning at least part of the longitudinal development of cavity 21 having an annular cross-section, as can be seen in FIG. 2 The solution being provided by this invention also envisages the arrangement of several labyrinthine lengths intercalated with regions wherein the gas flows freely between the mutually opposed surfaces of bodies 20, 22. A quick expansion of the cooling fluid can thus be obtained and hence provides an instant cooling of the wall of body 20 and latter on a slowing of the circulation of said fluid up to the discharge.

The fluid circulation means comprise a connection for connecting a cooling fluid source to an inlet duct 17 in communication with fluid passage 25.

In an operative situation the internal body 22 is housed inside cavity 21 of external body 20. Cavity 21 of external body 20 has a closed end and an open end through which the internal body 22 is introduced. Internal body 22 has an end attached to a closure cap 13 being shaped in such a way as to be connected to the external body 20 thus closing said open end of cavity 21.

In the embodiment shown in FIG. 1 the internal body is attached to the closure cap 13. Closure cap 13 is fixed to external body 20 by means of screws 27 or similar fasteners, such as by clipping, and an annular seal 26 is compressed between external body 20 and closure cap 13 attached to internal body 22.

In the exemplary embodiments being shown in FIGS. 1, 2, 6, 7 and 9 the aforecited elastically deformable surface is provided by a cord 50 of elastomeric material being firmly attached (for example fixed by an adhesive) to the outer wall of body 22 or to the inner wall of the first body 20.

As can be seen in the aforementioned FIGS., on the wall being provided for attaching the elastomeric cord 50 half round grooves or channellings are defined wherein the aforecited cord 50 is seated.

The aforementioned grooving having a helical or another labyrinthine course can extend along the whole length of the outer wall of body 22, or else it can only exist in one or more lengths of said surface.

Figure 7:
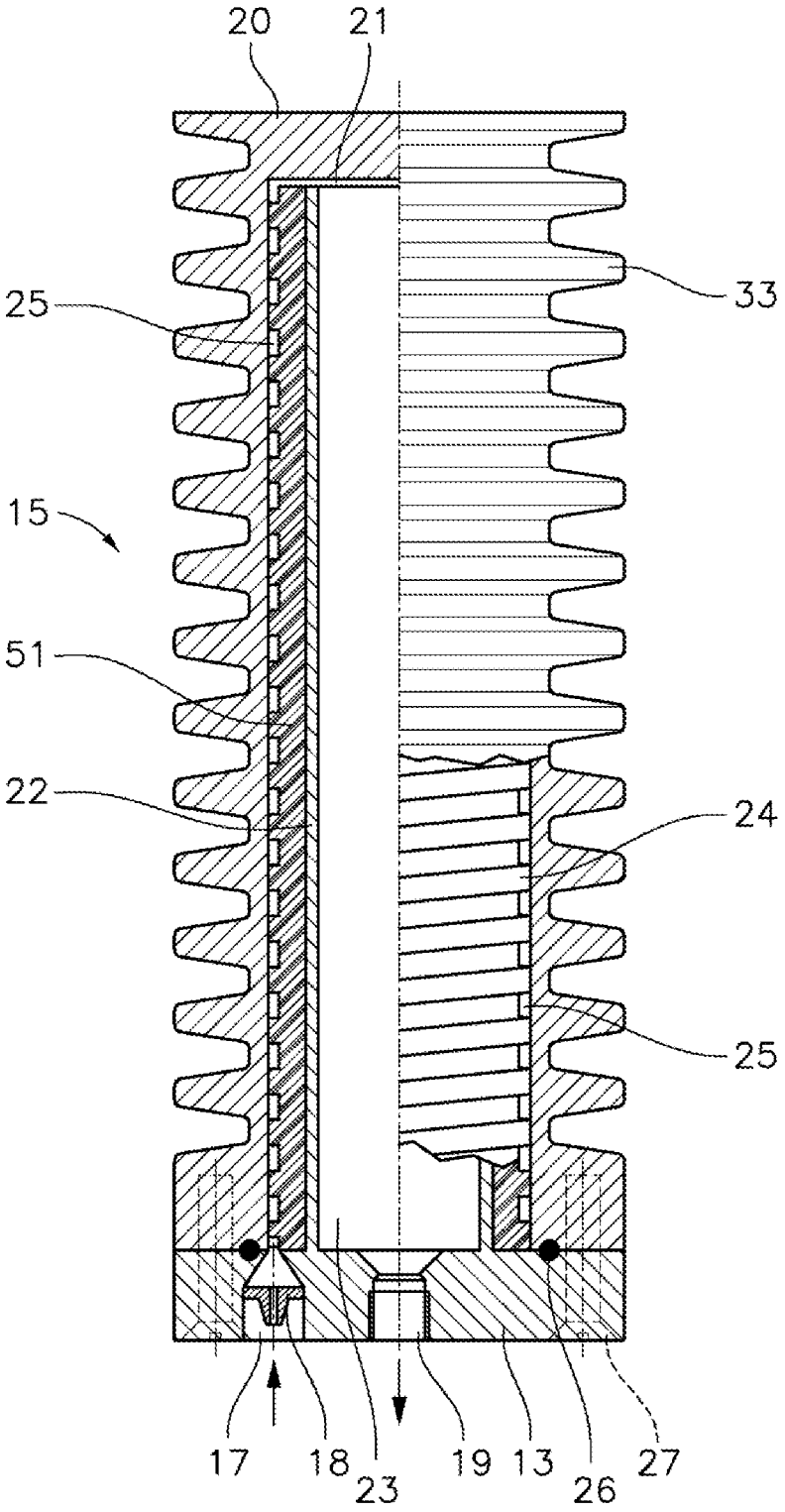
FIG. 7 is an enlarged, partially cross-sectional view showing an alternative construction of the cooling device of FIG. 1, wherein an elastomeric cover with a helical grooving is arranged on the inner body.

In an alternative embodiment of the invention being shown in FIG. 7 it has been foreseen that the elastically deformable surface is provided by the outer wall of the very body 22, said outer wall being at least in its surface of a deformable nature (being for example provided with an elastomeric cover 51) and having a grooving defined on it which provides the aforecited passage 25 for the fluid circulation in relation to the smooth inner wall of the first body 20.

An inlet duct 17 and an exhaust duct 19 are formed in closure cap 13. Said inlet duct is in communication with an end of fluid passage 25 adjacent to the open end of cavity 21 of external body 20, whereas said exhaust duct 19 is in communication with said central channel 23 of internal body 22, said central channel being in its turn in communication with an opposite end of fluid passage 25 adjacent to the closed end of cavity 21 of external body 20. The exhaust duct 19 could be provided in the bottom or side portion of cap 13.

Inlet duct 17 is associated to a connection for connecting a cooling fluid source, such as for example a pressurised gas reservoir or cartridge 16 (FIG. 5) of a conventional, discardable type. This connection can for example and in a conventional manner comprise an internal thread provided in an end of inlet duct 17, an annular seal and a hollow punch 18 being designed to pierce a closure of said cartridge 16 and to thereby release the cooling fluid from cartridge 16 towards the inside of fluid passage 25 of exchanger 15.

Once having pierced the closure of cartridge 16 the whole cooling fluid being contained in this latter is discharged to the inside of fluid passage 25 and expelled to the atmosphere through exhaust duct 19, whereupon cartridge 16 is discarded. In an alternative embodiment (not shown) the volume of gas being expanded to the inside of fluid passage 25 is controlled by means of a valve associated either to the reservoir or cartridge 16 or to the inlet duct 17, this allowing to carry out multiple cooling fluid discharges with the contents of each reservoir or cartridge 16.

Figure 8:
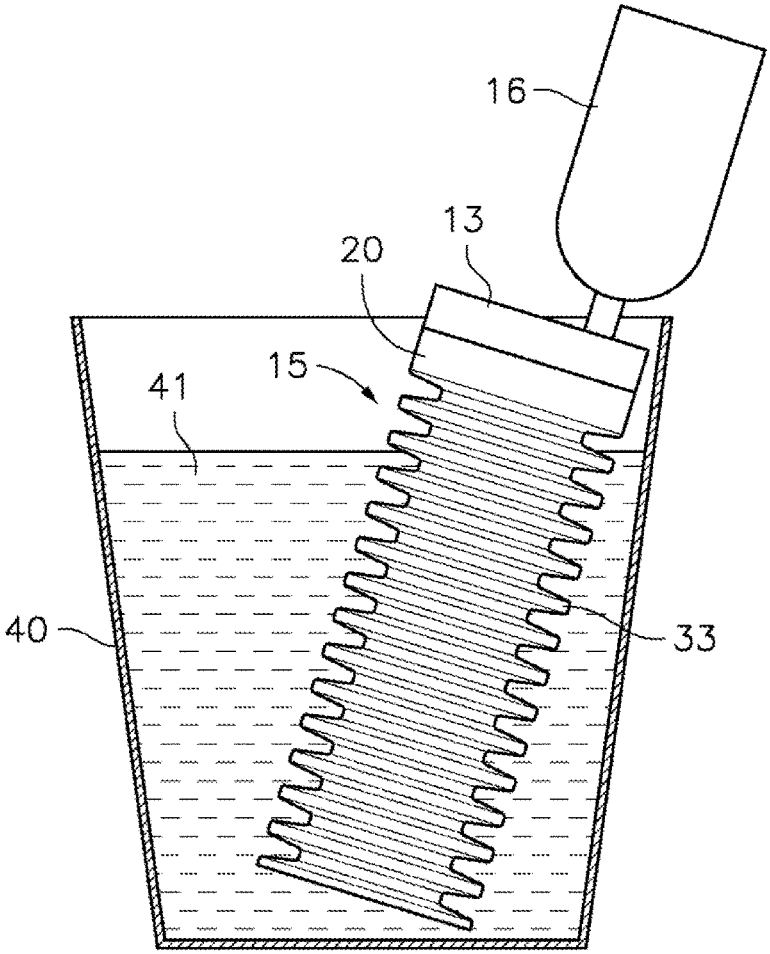
FIG. 8 is an elevational view of an exemplary use of a cooling device as per the exemplary embodiment of FIG. 7 for cooling the liquid in a container by introducing it into this latter.

As shown in FIG. 8, the heat exchanger 15 is shaped in such a way as to be totally or partially housed in a container 40 containing a liquid 41, with the outer surface of the external body 20 including the annular fins 33 in contact with said liquid 41 contained in container 40. When cartridge 16 is connected to the inlet duct 17 of the cooling device, the cooling fluid exits cartridge 16 and expands along fluid passage 25 of heat exchanger 15 till exiting through the exhaust duct 19, so that the external body 20 of the heat exchanger 15 is cooled and absorbs heat from the liquid 41 being in contact with it, thus lowering its temperature. The function of the annular fins 33 is to increase the heat transfer surface of the heat exchanger 15, even though tests having been carried out by the inventor have evidenced that they can be omitted in many cases, thus minimising the bulk of the device and facilitating its coupling to container 10.

Figure 9:
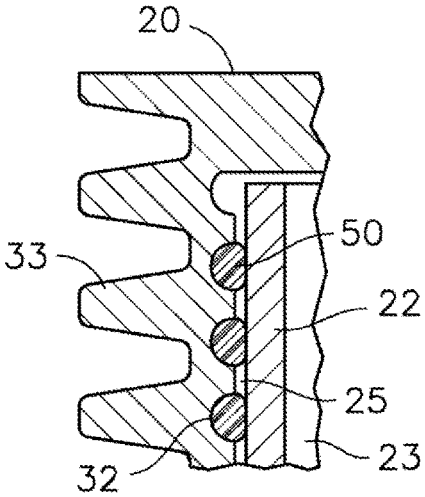
FIG. 9 is a partial, cross-sectional view of the cooling device as per the embodiment showing an alternative construction as opposed to that being shown in FIG. 1, wherein an elastomer is arranged on the inner wall of the external body and the outer wall of the internal body is smooth.

FIG. 9 shows an alternative construction for the helical passage making up the fluid passage 25 of the heat exchanger 15. This alternative construction is opposite to that being shown in FIG. 1, and in it the inner surface of cavity 21 of the external body 20 comprises a helical grooving 32 wherein a cord 50 is seated, whereas the outer surface of the internal body 22 is smooth, so that the fluid passage 25 is equally delimited by said elastomeric cord 50 on the inner surface of cavity 21 of the external body 20 in cooperation with the smooth outer surface of said internal body 22.

It will be appreciated that the different alternatives for the construction of the fluid passage 25 are independent from the shape of the outer fins of external body 20 and from the configuration of the internal body 22 and the closure cap 13, and so they can be freely combined.

Figure 10:
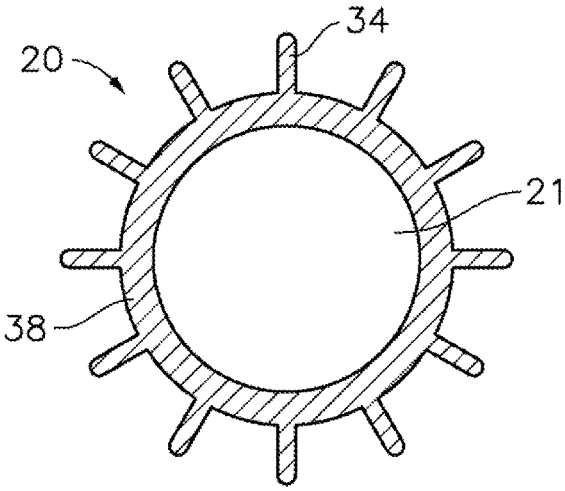
FIG. 10 is a cross-sectional view of a cooling device as per still another embodiment of the first aspect of the present invention.

In FIG. 10 the external body 20 preferably has the shape of a tubular profile of constant cross-section including longitudinal fins 34 radially extending in a star shape from the outer surface and with cavity 21 provided with a smooth inner surface. This tubular profile of constant cross-section is fit to be obtained by extrusion.

Once cut to measure, a length of tubular profile 38 obtained by extrusion has two open ends and one of them would be closed by a cover in order to thus provide the outer body 20.

In any of the different embodiments the external body 20 is preferably made of a material with a high heat-transfer coefficient, such as a metallic material, and more preferably a light metal alloy being compatible with foodstuffs, such as an aluminium alloy, this latter besides allowing to obtain the external body 20 by extrusion. The internal body 22 is preferably made of a material with a low heat-transfer coefficient, such as for example a plastics material.

In relation to FIGS. 3, 4*a*, 4*b* and 5 a liquid container 10 as per an embodiment of the second aspect of the present invention will be now described which includes a selective cooling device being similar to that having been described above in relation to FIG. 1. It is nevertheless to be noted that container 10 could alternatively include a selective cooling device being similar to any of the other embodiments of the first aspect of the present invention having been described above or falling within the scope of the claims.

The aforementioned container 10 comprises a cavity 10*a* (see FIG. 6) for housing a liquid and a first opening 11 through which said cavity 10*a* can be filled or emptied. This first opening 11 is provided with a closure element or plug 11*a*, and a discretional drinking element. Container 10 furthermore comprises a second opening 12 at an end opposite to the first opening 11. Around this second opening a first coupling element 12*a* is formed for example in the shape of an external thread.

Closure cap 13 has a radial extension at whose perimeter a second coupling element 13*a* (FIG. 4B) is formed for example in the shape of an internal thread conjugated with the aforementioned external thread making up the first coupling element 12*a* of container 10. By means of the respectively first and second coupling elements 12*a*, 13*a* the cooling device can thus be coupled to container 10 with closure cap 13 closing the second opening 12 of container 10 and the heat exchanger 15 is thus housed inside cavity 10*a* of container 10.

Figure 5:
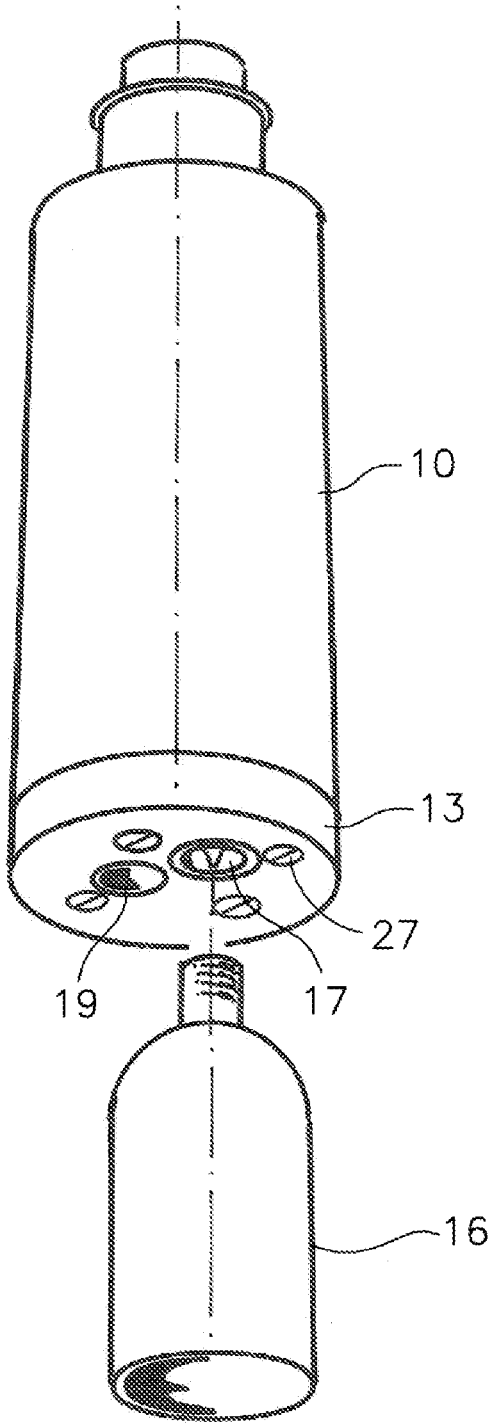
FIG. 5 is a perspective view of the container of FIG. 3 with the cooling device of FIG. 4B coupled to it and a cooling fluid source to be connected to a connection of the cooling device.
Figure 6:
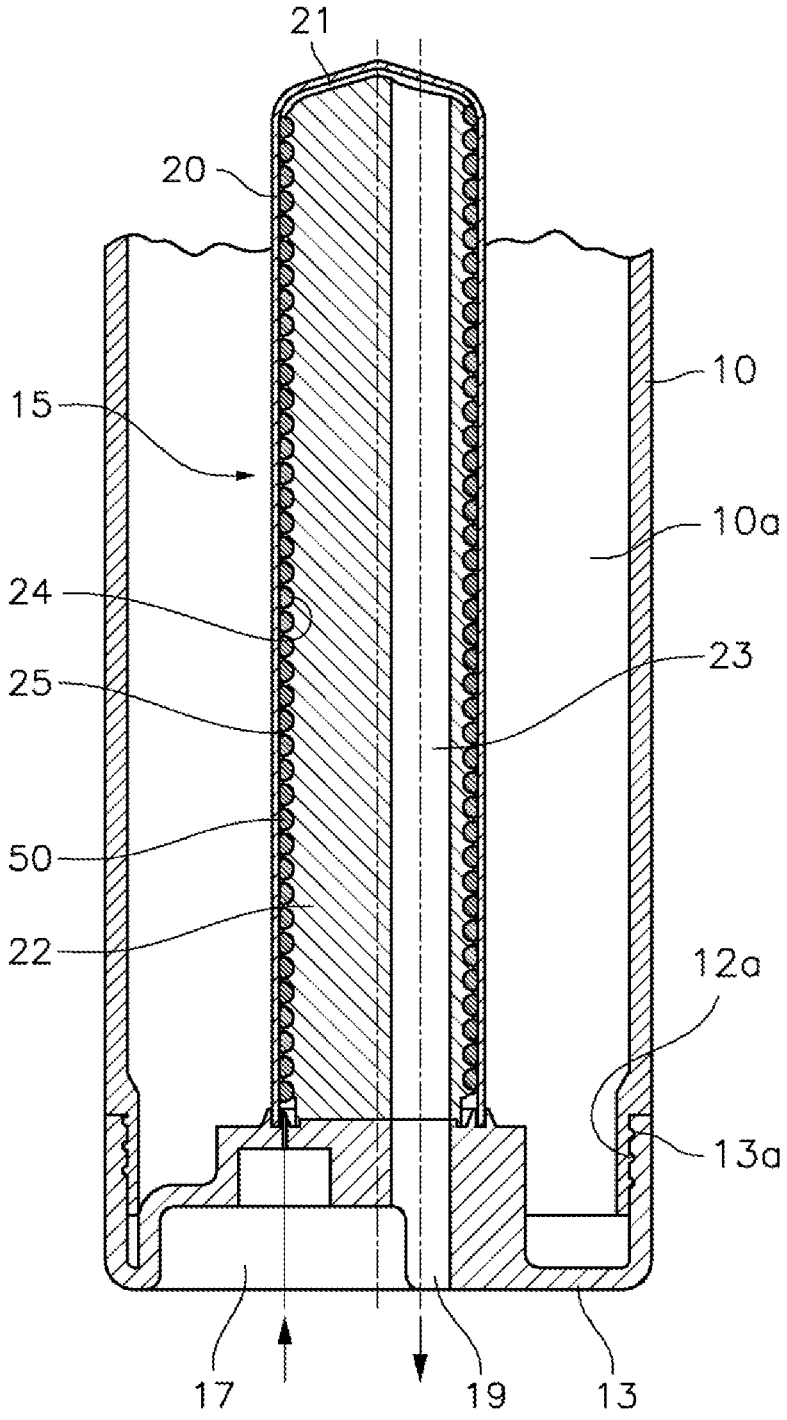
FIG. 6 is a side elevational, partially sectional view of the container of FIG. 3 with the cooling device of FIG. 4B coupled to it.

When as shown in FIG. 5 a cooling fluid source, such as for example a pressurised gas reservoir or cartridge 16, is coupled to a connection associated to the inlet duct 17, which in the embodiment being shown is to be found in the closure cap 13, the cooling fluid is discharged from cartridge 16 to the inside of fluid passage 25 and expelled to the atmosphere through the exhaust duct 19. The expansion of the cooling fluid along fluid passage 25 cools the external body 20 of the heat exchanger 15 and this latter then absorbs heat from the liquid contained in cavity 10*a* of container 10 and thus lowers its temperature. The function of the annular fins 33 is to increase the heat transfer surface of the heat exchanger 15.

Figure 4A:
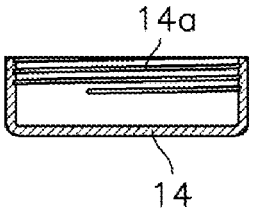
FIG. 4A is a cross-sectional view of an alternative cap for closing a second opening of the container of FIG. 3.
Figure 4B:
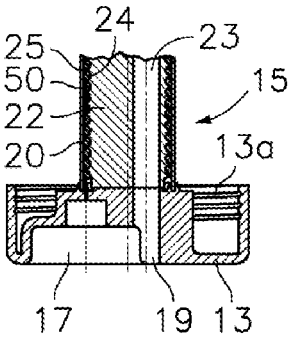
FIG. 4B is a partial, partially sectional view of a cooling device as per an embodiment of the second aspect of the present invention, said device being adapted to be coupled to the container of FIG. 3 instead of the alternative cap of FIG. 4A.

FIG. 4A illustrates a simple alternative cap 14 in whose perimeter a third coupling element 14*a* is formed for example in the shape of an internal thread conjugated with the aforementioned external thread making up the first coupling element 12*a* of container 10. By means of the respectively first and third coupling elements 12*a*, 14*a* the alternative cap can thus be coupled to container 10 thus closing its second opening 12.

Said alternative cap is provided to be used instead of cap 13 of the heat exchanger 15 of the cooling device in order to close the second opening 12 of container 10 when not using the cooling device. With the alternative cap 14 container 10 can thus be used as a conventional, transportable liquid container whenever the transported liquids do no need to be cooled.

The portable beverage container of the present invention including said selective cooling device finds application for example as a beverage can, container or canteen for hiking and bike bottle, among others.

Figure 3:
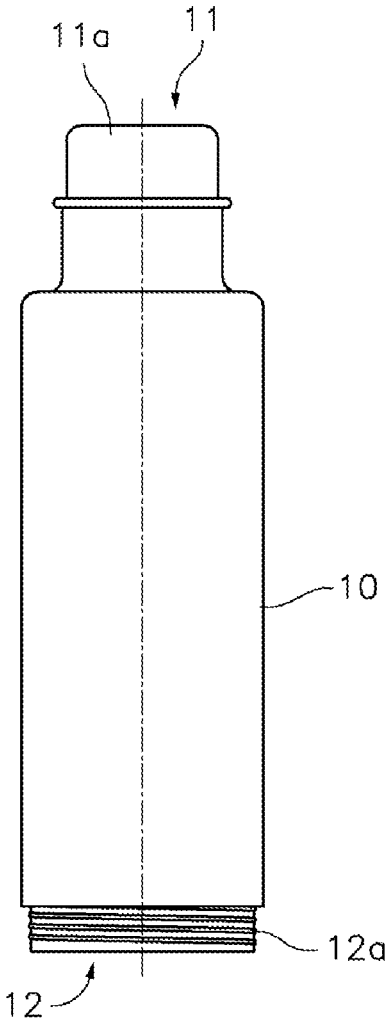
FIG. 3 is a side elevational view of a liquid container as per an embodiment of the first aspect of the present invention.

The invention could be implemented by means of an auxiliary container, with a coupling member for the device, such as portion 12*a* of FIG. 3, and any opportune configuration of the container, designed to receive a beverage quantity to be cooled.

Modifications, variations and combinations as based on the exemplary embodiments having been shown and described above will occur to a person ordinarily skilled in the art without departing from the scope of the present invention as defined in the appended claims.

The invention claimed is:

1. An assembly comprising:

a cooling apparatus comprising an elongate heat exchanger having an exterior surface, the cooling apparatus having an inlet duct and an outlet duct located in a closure cap disposed at an end thereof, the inlet and outlet ducts being in fluid communication with a cooling medium flow passage located within the elongate heat exchanger, the closure cap comprising a first coupling element; and an elongate hand-held liquid container having a cavity for housing a liquid, the cavity having an open end and configured to receive at least a portion of the elongate heat exchanger, the elongate hand-held container comprising a second coupling element that is engageable with the first coupling element to facilitate a coupling of the cooling apparatus with the elongate hand-held container to form a liquid-tight seal at the open end of the cavity, the first and second coupling elements facilitating both an attachment and a removal of the cooling apparatus from the elongate hand-held container.

2. The assembly according to claim 1, wherein the first coupling element is a female coupling element and the second coupling element is a male coupling element.

3. The assembly according to claim 1, wherein the first coupling element comprises a first set of threads located internal to the closure cap and the second coupling element comprises a second set of threads located on an external surface of the elongate hand-held liquid container.

4. The assembly according to claim 1, wherein the inlet duct of the closure cap comprises a coupling element configured for receiving and releasably retaining an end of a pressurized cooling medium cartridge.

5. The assembly according to claim 4, wherein the inlet duct further comprises a piercing element configured for piercing a closure at the end of the pressurized cooling medium cartridge.

6. The assembly according to claim 4, wherein the outlet duct of the closure cap exhaust to the atmosphere.

7. The assembly according to claim 1, wherein the cooling medium flow passage is defined at least in part by an elongate elastically deformable material arranged in an interior of the elongate heat exchanger, the elongate elastically deformable material extending along at least a portion of a longitudinal length of the elongate heat exchanger.

8. An assembly comprising:

a cooling apparatus comprising a first elongate body having an internal surface and an external surface; a second elongate body at least partially disposed in the first elongate body so that a gap exists between an external surface of the second elongate body and the internal surface of the first elongate body; an elongate elastically deformable material arranged in the gap in a state of radial compression between the internal surface of the first elongate body and the external surface of the second elongate body, the elongate elastically deformable material being arranged in the gap to form with one or both of the internal surface of the first elongate body and the external surface of the second elongate body a fluid passage spanning at least a portion of a longitudinal development of the gap, the fluid passage configured to receive and accommodate an expansion of a cooling medium; each of the first and second elongate bodies having a first end and an opposite second end, the cooling apparatus having a cooling medium inlet duct in fluid communication with a first end of the fluid passage and a cooling medium outlet duct in fluid communication with a second end of the fluid passage, the cooling medium inlet and outlet ducts being located at or adjacent the first ends of the first and second elongate bodies; each of the first ends of the first and second elongate bodies being coupled to a closure cap, each of the cooling medium inlet and outlet ducts residing in the closure cap; and an elongate hand-held liquid container having a first end, a second open end and a cavity disposed between the first end and second open end for housing a liquid, the first end configured for receiving or emptying a liquid from the container, the second open end and cavity configured for receiving the cooling apparatus;

the elongate hand-held container comprising a first coupling element and the closure cap comprising a second coupling element, the first and second coupling elements engagable with one another to facilitate a coupling of the cooling apparatus to the elongate hand-held container and to form a liquid-tight seal at the second end of the elongate hand-held container, the first and second coupling elements being disengageable to facilitate a removal of the cooling apparatus from the elongate hand-held container.

9. The assembly according to claim 8, wherein the first coupling element is a female coupling element and the second coupling element is a male coupling element.

10. The assembly according to claim 8, wherein the first coupling element comprises a first set of threads located internal to the closure cap and the second coupling element comprises a second set of threads located on an external surface of the elongate hand-held liquid container.

11. The assembly according to claim 8, wherein the inlet duct of the closure cap comprises a coupling element configured for receiving and releasably retaining an end of a pressurized cooling medium cartridge.

12. The assembly according to claim 11, wherein the inlet duct further comprises a piercing element configured for piercing a closure at the end of the pressurized cooling medium cartridge.

13. The assembly according to claim 11, wherein the outlet duct of the closure cap exhaust to the atmosphere.

14. A kit comprising:

a cooling apparatus comprising an elongate heat exchanger having an exterior surface, the cooling apparatus having an inlet duct and an outlet duct located in a first closure cap attached to an end thereof, the inlet and outlet ducts being in fluid communication with a cooling medium flow passage located within the elongate heat exchanger, the first closure cap comprising a first coupling element;

an elongate hand-held liquid container having a cavity for housing a liquid, the cavity having an open end and being configured with the cavity to receive at least a portion of the elongate heat exchanger, the elongate hand-held container comprising a second coupling element that is engageable with the first coupling element to facilitate a coupling of the cooling apparatus with the elongate hand-held container to form a liquid-tight seal at the open end of the cavity, the first and second coupling elements being disengageable to facilitate a removal of the cooling apparatus from the elongate hand-held container; and a second closure cap comprising a third coupling element that is engageable with the second coupling element of the elongate hand-held container to form a liquid-tight seal at the open end of the cavity, the second and third coupling elements being disengageable to facilitate a removal of the second closure cap from the elongate hand-held container, the second closure cap being devoid of any structure that extends appreciably into the interior of the cavity upon an attachment of the second closure plate with the elongate hand-held liquid container.

15. The kit according to claim 14, wherein each of the first and third coupling elements is a female coupling element and the second coupling element is a male coupling element.

16. The kit according to claim 14, wherein each of the first and third coupling elements comprises a first set of threads located internal to the first and second closure caps, respectively, and the second coupling element comprises a second set of threads located on an external surface of the elongate hand-held liquid container.

17. The kit according to claim 14, wherein the inlet duct of the closure cap comprises a coupling element configured for receiving and releasably retaining an end of a pressurized cooling medium cartridge.

18. The kit according to claim 17, wherein the inlet duct further comprises a piercing element configured for piercing a closure at the end of the pressurized cooling medium cartridge.

19. The kit according to claim 17, wherein the outlet duct of the closure cap exhaust to the atmosphere.

20. The kit according to claim 14, wherein the cooling medium flow passage is defined at least in part by an elongate elastically deformable material arranged in an interior of the elongate heat exchanger, the elongate elastically deformable material extending along at least a portion of a longitudinal length of the elongate heat exchanger.

* * * * *